US006868625B2

(12) United States Patent
Jacobsen et al.

(10) Patent No.: US 6,868,625 B2
(45) Date of Patent: Mar. 22, 2005

(54) METHOD AND DEVICE FOR SUBSEA DREDGING

(75) Inventors: Tom Jacobsen, Trondheim (NO); Terje Fagervold, N-Tustna (NO); Gunnar Fagervold, Lysoysundet (NO); Gustav Kvalvaag, Frei (NO)

(73) Assignee: Fossura AS, Tustna (NO)

( * ) Notice: Subject to any disclaimer, the term of this patent is extended or adjusted under 35 U.S.C. 154(b) by 0 days.

(21) Appl. No.: 10/239,169

(22) PCT Filed: Apr. 4, 2001

(86) PCT No.: PCT/NO01/00143

§ 371 (c)(1),
(2), (4) Date: Dec. 2, 2002

(87) PCT Pub. No.: WO01/75235

PCT Pub. Date: Oct. 11, 2001

(65) Prior Publication Data

US 2003/0121182 A1 Jul. 3, 2003

(30) Foreign Application Priority Data

Apr. 5, 2000 (NO) ..... 20001743

(51) Int. Cl.[7] ..... B63C 11/52
(52) U.S. Cl. ..... 37/313
(58) Field of Search ..... 37/307, 309, 313, 37/317, 319, 320–329; 405/190, 191, 188, 185

(56) References Cited

U.S. PATENT DOCUMENTS 813,935 A * 2/1906 Avery, Jr. ..... 405/185
3,683,521 A * 8/1972 Sloan et al. ..... 37/313
4,204,347 A * 5/1980 Wolters ..... 37/310
5,042,959 A * 8/1991 Tadatsu ..... 405/191
6,178,670 B1 * 1/2001 Susman et al. ..... 37/313

FOREIGN PATENT DOCUMENTS

| | | |
|---|---|---|
| DE | 19630297 | 1/1998 |
| EP | 91264 | 10/1983 |
| GB | 1466487 | 3/1997 |

OTHER PUBLICATIONS

"Remotely Operated Vehicles of the World," Oilfield Publications Ltd. (1995), p. 136, p. 196.

* cited by examiner

*Primary Examiner*—Robert E Pezzuto
(74) *Attorney, Agent, or Firm*—Dennison, Schultz, Dougherty & MacDonald

(57) ABSTRACT

Method and device for moving subsea rocks and sediments, particularly at significant depths, for example in connection with removal of protective rocks around subsea installations where maintenance is to be conducted. The device includes a rigid or at least partly flexible tubing thorough which masses may be transported with the aid of a pressure gradient produced by an ejector nozzle arranged externally in relation to the tubing, and fed with water from a water pump. The device further includes a chassis adapted to be transported along the sea bottom. The required power is supplied through a cable from the surface, while the tubing preferably is remotely controlled by a manipulator.

14 Claims, 2 Drawing Sheets

METHOD AND DEVICE FOR SUBSEA DREDGING

The present invention relates to a method of the kind described in the preamble of claim 1. The invention further relates to a device according to the preamble of claim 3 for conducting said method.

BACKGROUND OF THE INVENTION

For work at subsea oil and gas installations or in connections with such installations, e.g. maintenance work, there is often a need to move rocks and particulate material that partly covers the bodies that are to be repaired. It can be pipelines, valve housings and the like.

In a similar way a need may occur to remove sediments in connection with new installations on the sea bottom, or for removal of collected drill cuttings at platforms or the like.

Similar needs may also occur in connection with subsea work, like harbour works or work at barrage or quay structures.

DESCRIPTION OF RELATED ART

The most common way to remove sediments in connection with subsea work, is by utilizing large "fans", large and heavy suction devices with a high power consumption and specially designed excavators. Disadvantages are that they require a lot of power and/or other resources, they require large surface vessels, have a limited versatility, are as good as stationary, or they are not at all suited for deep waters.

NO patent No. 302.043 describes a dredge designed for subsea operations, especially to remove or move drill cuttings, comprising a motor, a pump device and an ejector, where the motor is designed to run the pump which in its turn provides a stream of water to the ejector, which is positioned in a tubing through which the cuttings or the like is supposed to be transported. The apparatus is designed to rest on the sea bottom and to receive energy from the surface, while the inlet end of the tubing is supposed to be moveable e.g. with the aid of a remote controlled mini submarine, a so called ROV.

This apparatus is not suited to move sediments with relatively large rocks, mainly because the pipeline has an effective loss of diameter due to the ejector's design and position. Further it has a geographically very limited work range as it is designed to rest at the sea bottom, even though the pipeline is designed to be somewhat moveable.

Japanese patent applications Nos. 043 25 799 A and 043 25 800 A describes an ejector pump system where the ejector is positioned mainly outside the pipeline so that the ejector does not reduce the effective diameter of the pipeline. From the abstract of these patent applications it is not possible to see what kind of utilizations these systems are meant for. Neither are there any indications of dimensions or power requirements for these systems.

SUMMARY OF THE INVENTION

It is an object with the present invention to provide a method for transportation of rocks and sediments under water, especially at deep waters.

It is a particular objective to provide a method for transportation of rocks with a typical maximum diameter of 250–500 mm.

It is a further object to provide an apparatus for performing said method, which apparatus should be versatile in its use, especially in the way that it should be easy to move around down at the sea bottom.

It is a still further object to provide such an apparatus that is easy to control, and which does not require more energy than what may be supplied from the surface, e.g. through a conventional electric cable.

BRIEF DESCRIPTION OF THE DRAWINGS

Below a more detailed description of a device according to the invention is given with reference to the accompanying drawings, where.

DESCRIPTION OF THE PREFERRED EMBODIMENTS

Figure 1:
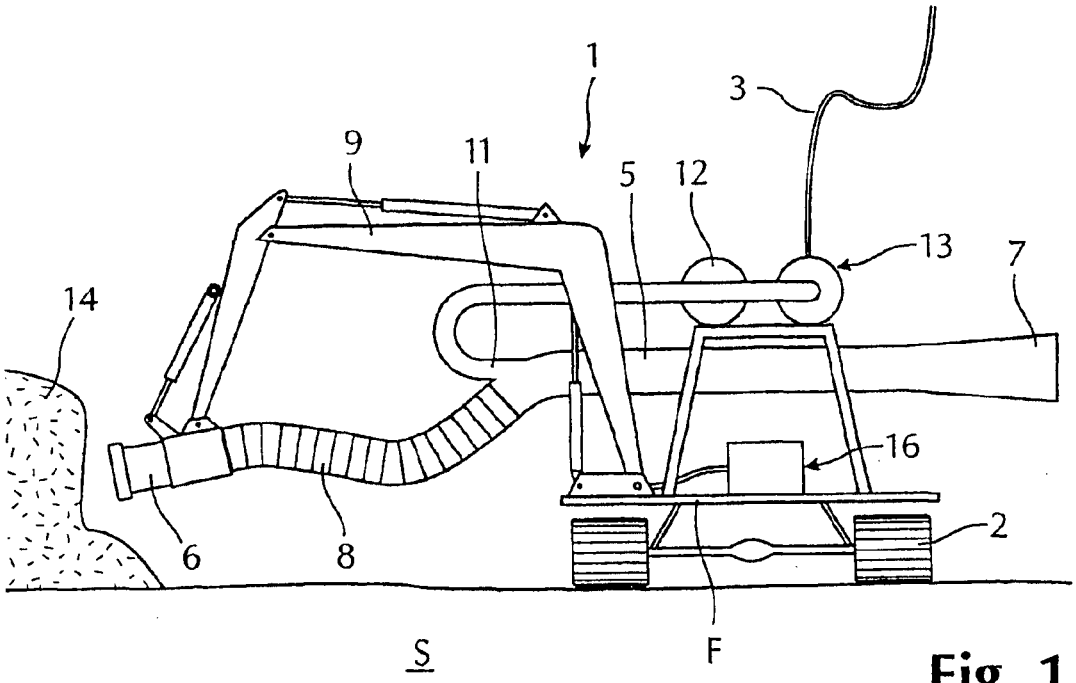
FIG. 1 is a schematic drawing of a first embodiment of the invention.

FIG. 1 shows a device 1 designed to move on the sea bottom S with the aid of belts 2 powered from the surface through a cable 3. The device comprises a tubing 5, preferably with a flexible section 8, said tubing having an inlet end 6 and an outlet end 7. To the tubing an ejector nozzle 11 is attached, said nozzle being supplied with water from a pump 12 powered by an hydraulic unit 13. All of said equipment are supported by a chassis F which again is supported by the belts 2. It is preferred that the tubing 5, when it includes a flexible section 8, further comprises a manipulator 9 which is able to move the tubing within certain degrees of freedom. In FIG. 1 the manipulator 9 consists of a multi-link arm controlled by means of an hydraulic unit 16. The device is adapted to transport sediments 14 including rocks of a size up to the diameter of the tubing 5 from one site to another, by the pressure gradient in the tubing set up by the ejector nozzle 11, providing a "vacuum from left to right in the drawing.

Figure 2:
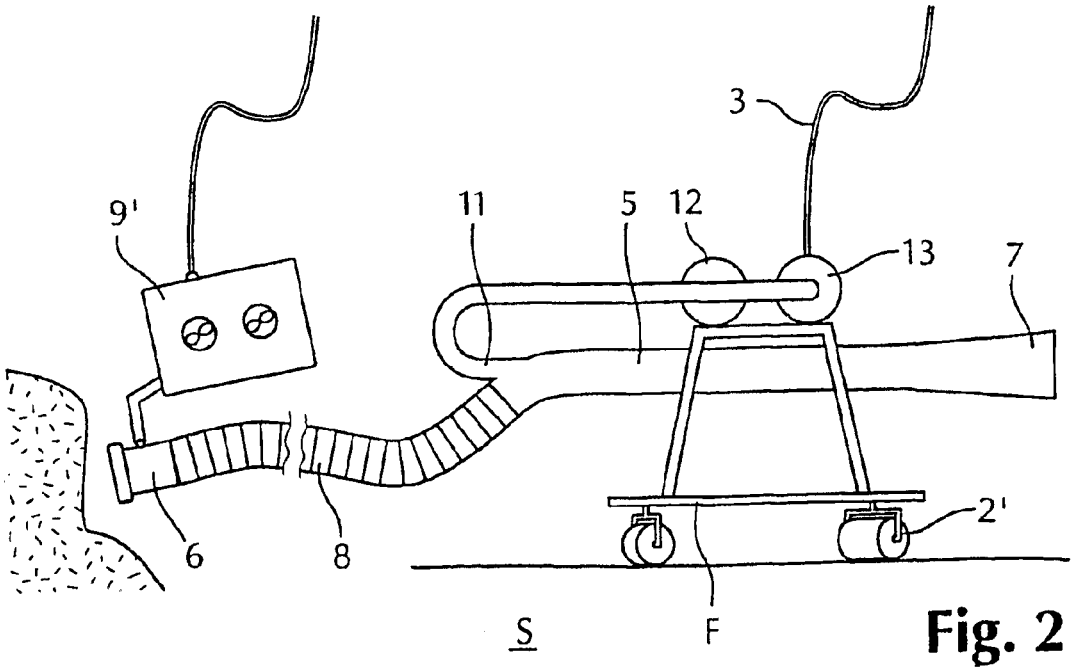
FIG. 2 is a schematic drawing of a second embodiment of the invention.

FIG. 2 shows an alternative embodiment of the invention. By this embodiment there is no power to the wheels or belts, as the device is supported by freely moving wheels 2' capable of being turned in several directions and preferably in any direction. The drawing shows 2 wheels while it is understood that at least two other wheels are hidden behind these two. Most typically the device in this embodiment has 4 wheels, but it may also have e.g. 3 or 5 wheels. As an alternative to freely moving wheels, freely moving belts may be utilized.

By the device according to FIG. 2, the manipulator 9' consists of a remotely operated vehicle (ROV) controlling the tubing 5 and, if the sea-bottom so allows, the ROV may pull the entire device 1 in a desired direction. It is to be understood that the freely moving wheels 2' need not have the shown shape, they may have any form suited for subsea transportation.

Figure 3:
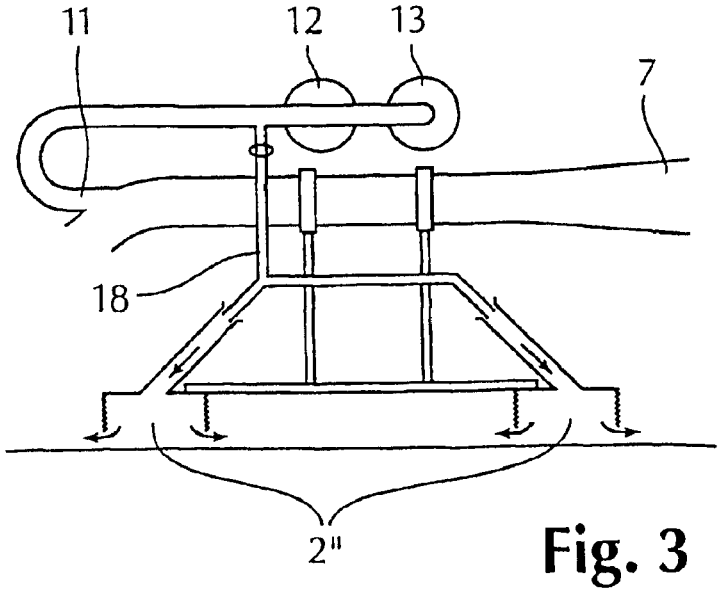
FIG. 3 is a simplified schematic drawing of a third embodiment of the invention.

FIG. 3 shows a further embodiment of the device according to the invention, an embodiment that may be seen as a variation of the embodiment of FIG. 2. FIG. 3 is simplified and does not show all the features of FIG. 2. The central aspect of this embodiment lies in the details indicated by the reference numeral 2", which may be denoted "water cushions" (cf. air cushions of a hovercraft), which may cause the device to float just above the sea level. The so-called water cushions are supplied with water from a powerful water pump, for instance the pump that feeds the ejector nozzle 11. In the drawing this is shown schematically in the form of a particular supply conduit 18 from the pump 12. Movement of tubing 5 and possibly of the entire device 1 may as shown in FIG. 2, be effectuated by means of a pulling force from an ROV through the tubing 5.

Figure 4A:
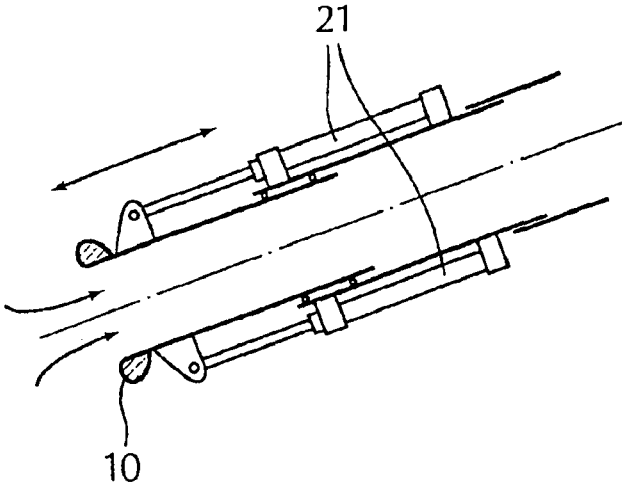
FIGS. 4*a–c* shows details of a device according to the invention according to any one of the embodiments shown in FIGS. 1–3.
Figure 4B:
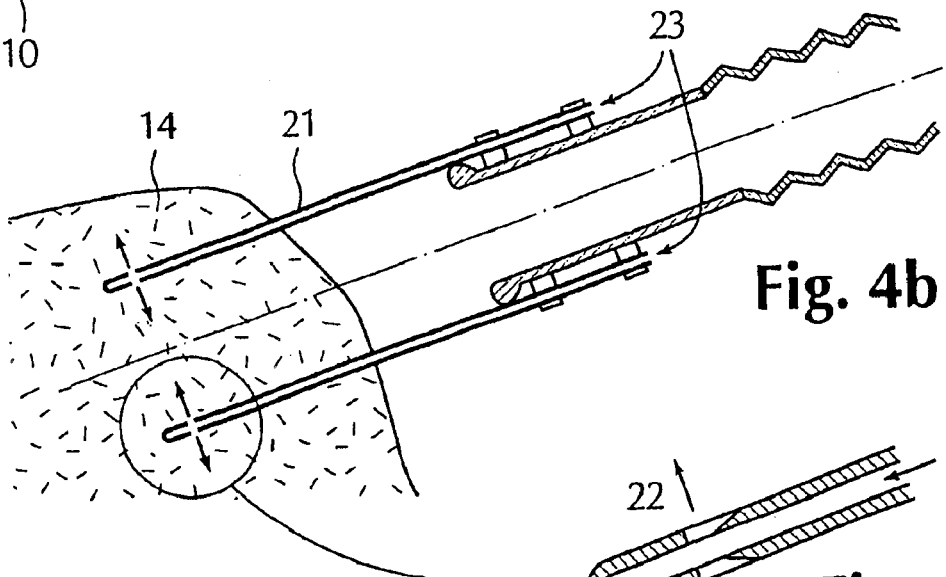
Figure 4C:
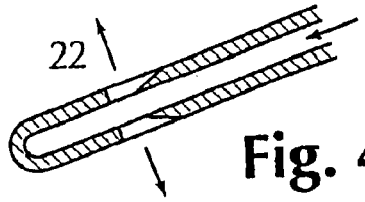

FIG. 4 shows details at the inlet end 6. The FIG. 4*a* shows that the outer part (mouth piece) of the inlet end 6 comprises telescopic units 21 may be pulled or pushed out. FIG. 4*b* further shows that the mouth piece may comprise an annulus "lance" 21 which is hollow and which is able to flush water through a plurality of openings 22 inwards as well as outwards relative to the mouth piece, so that the inlet end as such becomes shielded and not so easily will become packed when the mouth piece is pressed into the sediments. The water is fed to the lance through conduit 23 which may communicate with e.g. the water pump 12 or another suitable water pump.

At the inlet mouth piece 10 of the tubing 5 there may also be provided a nozzle (not shown) for backflushing of rocks etc. that might get stuck in the mouth piece.

Further it is preferred that the inlet mouth piece 10 is rounded and that the cross-section of the tubing is constant, and that any bend on the tubing 5 has sufficiently large radius to ensure that rocks will not get stuck. It is further preferred that the outlet end 7 of the tubing is shaped as a diffusor, as this reduces the frictional loss through the tubing.

The device according to the invention may be manufactured mainly in a plastic material with a density close to that of water, so that it is easy to support.

CALCULATION EXAMPLE

In the following example of utilization there is an assumption of one or two water pumps each powered by a motor of 75 kW. It is assumed that the tubing has an internal diameter of 300 mm. In the case of two pumps there is also conducted calculations for a 500 mm tubing. Further data are given in the table below.

| | | | | |
|---|---|---|---|---|
| Motor power (axle-) | kW | 75 | 150 | 150 |
| Power efficiency | % | 80 | 80 | 80 |
| Internal diameter | mm | 300 | 300 | 500 |
| Length (inlet-outlet) | m | 15 | 15 | 12 |
| Speed prior to mixing chamber | m/s | 5.8 | 7.4 | 5.9 |
| Required speed | m/s | 4.4 | 4.4 | 5.7 |
| Motive power (lifting height) | m | 2.5 | 4.2 | 1.8 |
| of which inlet loss is | m | 0.3 | 0.6 | 0.4 |
| frictional loss is | m | 1.4 | 2.3 | 0.7 |
| outlet loss is | m | 0.7 | 1.3 | 0.7 |
| Ca. capacity transport rocks | tons/hour | 70 | 120 | 100 |

PRACTICAL EXAMPLE

A commission conducted shows that the invention works in practice. During the summer of 1999, 1500 $m^3$ ($d_{max}$=ca. 150 mm) of rocks were moved with the aid of a corresponding ejector mechanism, carried by a remotely operated vehicle, ROV. The commission was conducted in Tengsfjorden, by an oil pipe at a depth of 540 m below sea level. For powering the water pumps, two hydraulic engines with a total effect of approx. 24 kW were used. The tubing was 10 m long and had an internal diameter of 250 mm.

During 26 effective work hours 1500 $m^3$ of rocks were moved, which corresponds to a capacity of 60 tons/hour. Only a minimal wearage was observed on the tubing in PE plastic. Later, several successful tasks have been performed with this technology.

In March 2000 the present invention was utilized at the Draugen field, at a depth of 300 m. The commission was carried out from the boat Seaway Kingfisher. 5 m length of a pipeline was uncovered during 40 minutes before the commission had to be interrupted. This corresponds to 20 $m^3$ mass or 45 tons/hour. Considering that the rocks were moved from a region where frequent re-locations of the device was required, the result was very satisfying. A 75 kW pump and a tubing of 15 m with an internal diameter of 300 mm was utilized.

The drawings and the examples are merely illustrations of the invention, which is only limited by the subsequent claims.

What is claimed is:

1. Method for moving subsea rocks and sediments along a sea floor, comprising:

arranging on a movable chassis tubing which has a substantially constant cross-section between a mouth end and an ejection end, and which is flexible over at least a portion thereof, an ejector nozzle external to the tubing and connected to the tubing between the mouth end and the ejection end, a water pump which is connected to the ejector nozzle opposite to the connection to the tubing, and a power cable to supply power to the chassis from the sea surface;

disposing the movable chassis with tubing, ejector nozzle pump and power cable on the sea floor;

producing a pressure gradient in the tubing by pumping water from the water pump through the ejector nozzle, creating thereby suction at the mouth end of the tubing; and utilizing the suction to move rocks and sediment from a first point on the sea floor adjacent to the mouth end to a second point on the sea floor adjacent to the ejection end.

2. Method as claimed in claim 1, wherein the tubing is remotely controlled by means of a manipulator.

3. Method as claimed in claim 2, wherein the manipulator is a hydraulically controlled multi-link arm.

4. Method as claimed in claim 1, wherein the chassis is provided with belts or wheels to move the chassis along the sea bottom with power provided to the belts or wheels.

5. Method as claimed in claim 2, wherein the chassis is provided with belts or wheels to move the chassis along the sea bottom with power provided to the belts or wheels, the belts or wheels are constructed and arranged to turn freely in several directions, the manipulator is an ROV and the ROV is utilized for moving the chassis as well as for controlling the tubing.

6. Method as claimed in claim 5, additionally comprising furnishing the chassis with water cushions that are fed with water, at least one water pump enabling the chassis to float above the sea bottom using an ROV as the manipulator, wherein the ROV is utilized for moving the chassis and for controlling the tubing.

7. Device for moving subsea rocks and sediments along a sea floor, comprising a chassis constructed and arranged for movement along the sea floor, having disposed thereon:

tubing which is flexible over tubing which has a substantially constant cross-section between a mouth end and an ejection end, and which is flexible over at least a portion thereof, an ejector nozzle external to the tubing and connected to the tubing between the mouth end and the ejector end, a water pump which is connected to the ejector nozzle opposite to the connection to the tubing, and a power cable to supply power to the chassis from the sea surface, whereby pumping water from the pump through the ejector nozzle creates suction at the mouth end of the tubing sufficient to pick up rocks and sediment from the sea floor adjacent the mouth end of the tubing, and deposit the rocks and sediment on the sea floor adjacent the ejection end of the tubing.

8. Device as claimed in claim 7, additionally comprising a manipulator to remotely control the tubing.

9. Device as claimed in claim 8, wherein the manipulator is a hydraulically controlled multi-link arm.

10. Device as claimed in claim 7, wherein the chassis is supported by belts or wheels and is constructed and arranged to be transported along the sea bottom by power to the belts or the wheels.

11. Device as claimed in claim 8, wherein the manipulator is an ROV that is controlled substantially independently of the device.

12. Device as claimed in claim 11, wherein the chassis is supported by freely turning belts or wheels that optionally may be turned in any direction, and is constructed and arranged to be transported along the sea bottom by a pull force exerted by the ROV through the tubing.

13. Device as claimed in claim 11, wherein the chassis is provided with water cushions facing the sea bottom and fed with water from the water pump or by and additional pump, whereby the chassis may partly float above the sea bottom and is arranged to be transported along the sea bottom by a pull force exerted by the ROV through the tubing.

14. Device as claimed in claim 8, wherein the first and second ends of the tubing are disposed adjacent the chassis.

* * * * *